US005104499A

United States Patent [19]

Millet

[11] Patent Number: 5,104,499

[45] Date of Patent: Apr. 14, 1992

[54] ELECTROLYTIC PRODUCTION OF ALKALI METAL CHLORATES/PERCHLORATES

[75] Inventor: Jean-Christophe Millet, Sassenage, France

[73] Assignee: Atochem, Puteaux, France

[21] Appl. No.: 619,427

[22] Filed: Nov. 29, 1990

[30] Foreign Application Priority Data

Nov. 29, 1989 [FR] France ..... 89 16014

[51] Int. Cl.[5] ..... C25B 1/28

[52] U.S. Cl. ..... 204/82; 204/95; 204/129

[58] Field of Search ..... 204/82, 95, 129

[56] References Cited

U.S. PATENT DOCUMENTS

| | | | |
|---|---|---|---|
| 3,518,173 | 6/1970 | Crane | 204/82 |
| 3,518,180 | 6/1970 | Grotheer | 204/268 |
| 3,878,072 | 4/1975 | Cook, Jr. et al. | 204/95 |
| 3,897,320 | 7/1975 | Cook, Jr. | 204/95 |
| 4,627,899 | 12/1986 | Smith et al. | 204/95 |
| 5,004,527 | 4/1991 | Millet et al. | 204/95 |

OTHER PUBLICATIONS

Extended Abstracts, Fall Meeting, Honolulu, Hawaii, 18-23 Oct., 1987, vol. 87-2, pp. 1629-1630, abstract No. 1177: A. Tasaka et al.: "Apparent activation energies for electrochemical chlorate-formation reaction on DSA--type electrode", p. 1629, colonne de gauche, lignes 13-32, colonne de droite, lignes 1-6.

*Primary Examiner*—John Niebling
*Assistant Examiner*—David G. Ryser
*Attorney, Agent, or Firm*—Burns, Doane, Swecker & Mathis

[57] ABSTRACT

The alkali metal chlorates (or perchlorates) are produced by electrolyzing the anolyte contained in the anode compartment of an electrolytic cell compartmentalized by means of a selectively permeable cationic membrane into said anode compartment and a cathode compartment, said anolyte having a pH ranging from about 6.2 to about 6.6 and comprising an aqueous solution of from about 100 g/l to about 200 g/l of the corresponding alkali metal chloride (or chlorate) and such amount of the desired alkali metal chlorate (or perchlorate) that the final product chlorate (or perchlorate) may be directly crystallized from the electrolyzed anolyte, and said cathode compartment containing a catholyte comprising an aqueous solution of the corresponding alkali metal hydroxide and wherein hydrogen gas is evolved.

6 Claims, No Drawings

ELECTROLYTIC PRODUCTION OF ALKALI METAL CHLORATES/PERCHLORATES

BACKGROUND OF THE INVENTION

1. Field of the Invention

The present invention relates to the preparation of an alkali metal chlorate or perchlorate by electrolysis, in an aqueous medium, of either the corresponding alkali metal chloride or chlorate, respectively.

2. Description of the Prior Art

It is known to this art to conduct the above electrolysis in an electrolytic cell designed and equipped in a manner suitable for the electrolysis of sodium chloride into chlorine and sodium hydroxide, designated a "chlorine-soda" electrolysis, but in which no porous barrier, diaphragm or membrane is disposed intermediately between the cathode and the anode, such that the cell is not divided into a cathode and an anode compartment.

In the description that follows, the preparation of an alkali metal chlorate is described. However, such description, including the description of the invention, is also applicable to the preparation of an alkali metal perchlorate.

The aforementioned prior art process, in actual practice, is typically carried out in the presence of hexavalent chromium values, sodium chromate or sodium bichromate in order to limit the deleterious cathodic reduction of hypochlorite and/or chlorate ions. The disadvantages of chromium, both relative to process economics as well as from a standpoint of environmental concerns, are set forth, for example, in U.S. Pat. No. 4,295,951. The cathode described in this '951 patent for the conventional electrolysis of chloride into chlorate in a noncompartmentalized cell makes it possible to reduce, but not to completely eliminate the parasitic cathode reactions. The concomitant loss of electrical energy, even if on a reduced scale, clearly presents an economic disadvantage.

Processes have also been proposed to this art for the electrolytic preparation of chlorate from chloride, using a compartmentalized cell designed and equipped in a manner similar to that of a "chlorine-soda" electrolysis cell.

For example, in the processes described in FR 1,502,519, BE 690,501 and U.S. Pat. No. 3,878,072, the chlorine and the alkali metal hydroxide formed in the compartmentalized cell react with each other outside the anode and the cathode compartments to produce the chlorate, the formation of which is avoided in the electrolysis proper.

Again for example, in the process described in FR 2,249,973, the production of chlorate requires a plurality of electrolytic cells, a first compartmentalized electrolytic cell for producing gaseous chlorine and an aqueous solution of an alkali metal hydroxide, as well as a second noncompartmentalized cell which employs the anolyte of the first cell; this plurality of compartments is critical for the production of chlorate.

As indicated above and as is generally well known to this art, the use of hexavalent chromium in the electrolysis of chloride into chlorate in a noncompartmented cell, such as the second cell of the process described in the aforesaid FR 2,249,973, is a necessary evil if an acceptable electrolytic yield is to be attained. But chromium values, together with the disadvantages and drawbacks thereof, are also present in other processes, such as those described, for example, in FR 1,502,519 and BE 690.501, which entail the use of a compartmented cell.

The process described in FR 2,249,978 presents the additional disadvantage of requiring that the chlorate produced in the second cell be treated to separate the chloride, prior to isolation of the chlorate. This disadvantage also exists in the process described in U.S. Pat. No. 3,878,072, wherein, in order to insure a satisfactory production of chlorate, the concentration of the chloride in the anolyte is increased.

Finally, in none of the known processes for the preparation of chlorate using a compartmented cell is the production of only chlorate assured.

SUMMARY OF THE INVENTION

Accordingly, a major object of the present invention is the provision of an improved process for the electrolytic production of an alkali metal chlorate (or perchlorate) that is conspicuously devoid of those disadvantages and drawbacks to date characterizing the state of this art, namely, the presence of deleterious hexavalent chromium values, the requirement for a special electrode, and the necessity of separating chloride prior to the desired chlorate. In addition, the process according to the invention does not couple the production of chlorate with any other production.

Briefly, the present invention features a process for the preparation of an alkali metal chlorate (or perchlorate), comprising a one-stage electrolysis, of an aqueous anolyte medium, including the chloride of such alkali metal, in the anode compartment of a "chlorine-soda" cell compartmentalized by a single, selectively permeable cationic membrane into an anode and a cathode compartment, and which cathode compartment contains an aqueous solution of the hydroxide of such alkali metal and in which hydrogen is produced. The chlorate is produced in a single stage by said electrolysis, by electrolyzing, at a pH ranging from about 6.2 to about 6.6, an aqueous anolyte solution of chloride containing, per liter, from approximately 100 g to 200 g of chloride values and such amount of the desired alkali metal chlorate that the chlorate produced may be directly separated from the electrolyzed aqueous anolyte by crystallization.

DETAILED DESCRIPTION OF THE PREFERRED EMBODIMENTS OF THE INVENTION

More particularly according to the present invention:

(i) the pH of the aqueous solution of the alkali metal chloride in the anode compartment, or the pH of the anolyte, preferably ranges from about 6.3 to about 6.5;

(ii) the anolyte preferably contains an amount of said chloride ranging from about 120 g/l to about 150 g/l;

(iii) the amount of the chlorate present together with the chloride is such that the chlorate produced may be directly isolated from the electrolyzed aqueous chloride solution, and is readily determined from the known crystallization diagrams of water/chloride/chlorate systems; such amount may range, for example, from about 400 g to about 600 g per liter of anolyte;

(iv) hydrogen is produced in essentially pure state in a yield that is practically equal to 100%;

(v) the pH of the anolyte is easily controlled by transferring the $OH^-$ ions produced in the cathode compartment into the anode compartment; such control may be carried out, for example, using a pump, the output of which is controlled at the desired pH value;

(vi) by a "chlorine-soda" type electrolytic cell is intended, as indicated above, a compartmentalized electrolytic cell per se known to this art and suitable for the production of gaseous chlorine together with an aqueous solution of sodium hydroxide by the electrolysis, in an aqueous medium, of sodium chloride;

(vii) in the known operation of "chlorine-soda" electrolysis:

(a) the cell housing is fabricated of a conventional material such as steel, concrete, and is lined, for example, with caoutchouc, rubbers or a suitable plastic, such as polyvinyl chloride, polyvinylidene chloride, polypropylene, polytetrafluoroethylene, various resins, preferably reinforced;

(b) the cathode is typically made of steel or a precious metal, such as platinum, for example deposited onto steel;

(c) the anode may be, for example, a precious metal, such as platinum or ruthenium oxide deposited onto a conductive metal support, such as titanium;

(d) the membrane is selected from among numerous materials generally available in the form of thin plates and sheets, for example a hydroxylated copolymer of a perfluorinated hydrocarbon and a fluorosulfonated perfluorovinylether, such as a copolymer of tetrafluoroethylene or hexafluoropropylene with perfluoro-[2-[2-fluorosulfonylethoxy]propylvinyl ether], or a sulfostyrenated perfluorinated ethylene/propylene polymer;

(e) the anolyte and the catholyte are uniform, i.e., each is respectively the same in the space which it occupies, in particular relative to its pH, its temperature and composition (the uniformity of the catholyte is normally due to the agitation provided in the cathode compartment by the release of hydrogen; the anolyte is uniform due to the agitation provided by forced circulation, normally by means of a pump, while the constancy and stability of the composition of each of the two uniform electrolytes, over time, may be assured by continuously and simultaneously introducing chloride, in aqueous solution, into the anode department and water into the cathode department in amounts of chloride and water such that said amounts equal the amounts of chloride and water which, in a combined state or form, are continuously and predeterminately withdrawn from the electrolytic cell).

U.S. Pat. No. 3,878,072 and FR 2,249,973, for example, provide further details relative to the compartmentalized cell and the membranes suitable therefor.

The temperature of the anolyte or the catholyte advantageously ranges from about 30° C. to the boiling point of each of them.

The only products formed are the chlorate and hydrogen, according to the overall reaction scheme:

$$MeCl + 3H_2O \rightarrow MeClO_3 + 3H_2$$

wherein Me is an alkali metal.

The only byproducts formed are oxygen and chlorine, in the anode compartment, i.e., small amounts of oxygen and even smaller amounts of chlorine. The total flow rate of gaseous oxygen and chlorine constitute less than 5%, generally less than 3%, of the flow of gaseous hydrogen exiting the cathode compartment. If necessary, the small amount of chlorine present in the oxygen may easily be recycled into the cell after having been separated from the oxygen by means of the alkali metal hydroxide (the alkali metal hydroxide present in the cathode compartment may be used for this purpose).

The above description of the process according to the invention for the production of chlorate from the corresponding chloride is also directly applicable to the production of perchlorate from the corresponding chlorate; in the latter case the only products are perchlorate and hydrogen according to the overall reaction scheme:

$$MeClO_3 + H_2O \rightarrow MeClO_4 + H_2$$

wherein Me is an alkali metal, the pH of the anolyte ranges from about 6 to about 10 and the amount of the perchlorate present with the chlorate in the anolyte is such that the perchlorate produced may be separated directly by crystallization from the aqueous solution of chlorate electrolyzed, and typically ranges from about 1,000 g to about 1,200 g per liter of anolyte.

In order to further illustrate the present invention and the advantages thereof, the following specific examples are given, it being understood that same are intended only as illustrative and in nowise limitative.

EXAMPLE 1

In this example, the electrolytic cell was lined with polytetrafluoroethylene, compartmentalized into an anode and cathode compartment by means of a selectively permeable cationic type membrane made of Nafion 117® marketed by DuPont, the anode comprised titanium provided with a coating based on ruthenium oxide, and the cathode was of steel.

Each of the electrodes had a surface area of 0.5 $dm^2$.

The catholyte was an aqueous solution of sodium hydroxide, at a temperature of 63° C. and containing 20% by weight of sodium hydroxide.

The anolyte was an aqueous solution of sodium chloride, at a temperature of 63° C. and containing, per liter, 150 g sodium chloride and 500 g sodium chlorate, prior to the electrolysis.

The electrolysis of the aqueous solution of sodium chloride in the anode compartment was carried out by applying a current intensity of 10 amperes to the terminals of the electrodes.

In the cathode compartment, the agitation of the catholyte by the release of hydrogen was sufficient to insure uniformity.

In the anode compartment, the uniformity of the anolyte was assured by forced circulation by means of a pump, with a flow rate, in the present example, of 70 l/b.

The pH of the anolyte was controlled at 6.3 to 6.4 by supplying $OH^-$ ions by means of a pump, in the amount required, from the cathode compartment to the anode compartment.

The electrolysis was continued until the anolyte contained no more than 120 g/l sodium chloride.

Sodium chlorate was produced in this manner at an anode yield of 87.3%, calculated from the amount of oxygen byproduct at the anode.

EXAMPLE 2

The procedure of Example 1 was repeated, except that a Nafion 902® membrane marketed by DuPont was used, the anolyte was at a temperature of 71° C. and the anolyte recirculation rate was 160 l/h.

The sodium chlorate was produced in the higher anode yield of 93%, calculated from the amount of oxygen byproduced at the anode, this yield being attained in the absence of hexavalent chromium values.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A process for the production of an alkali metal chlorate, which comprises electrolyzing an anolyte contained in an anode compartment of an electrolytic cell compartmentalized by means of a selectively permeable cationic membrane into said anode compartment and a cathode compartment, said anolyte having a pH ranging from about 6.2 to about 6.6 and comprising an aqueous solution of from about 100 g/l to about 200 g/l of the corresponding alkali metal chloride and such amount of the desired alkali metal chlorate that the final product chlorate may be directly crystallized from the electrolyzed anolyte, and said cathode compartment containing a catholyte comprising an aqueous solution of the corresponding alkali metal hydroxide and wherein hydrogen gas is evolved.

2. The process as defined by claim 1, said anolyte comprising an aqueous solution of from about 120 g/l to 150 g/l of the corresponding alkali metal chloride.

3. The process as defined by claim 1, said anolyte having a pH ranging from about 6.3 to 6.5.

4. The process as defined by claim 1, comprising maintaining the pH of said anolyte by transferring hydroxyl ions formed in said cathode compartment to said anode compartment.

5. The process as defined by claim 1, said alkali metal comprising sodium.

6. A process for the production of an alkali metal perchlorate, which comprises electrolyzing, an anolyte contained in an anode compartment of an electrolytic cell compartmentalized by means of a selectively permeable cationic membrane into said anode compartment and a cathode compartment, said anolyte having a pH ranging from about 6 to about 10 and comprising an aqueous solution of from about 100 g/l to about 200 g/l of the corresponding alkali metal chlorate and such amount of the desired alkali metal perchlorate that the final product perchlorate may be directly crystallized from the electrolyzed anolyte, and said cathode compartment containing a catholyte comprising an aqueous solution of the corresponding alkali metal hydroxide and wherein hydrogen gas is evolved.

* * * * *